US007870951B1

(12) United States Patent
Orsi

(10) Patent No.: US 7,870,951 B1
(45) Date of Patent: Jan. 18, 2011

(54) SINGLE USE INK CUP HOLDER AND HAND TRAY

(76) Inventor: Mark Anthony Orsi, 1705 Harrison La., Youngstown, NY (US) 14174

( * ) Notice: Subject to any disclaimer, the term of this patent is extended or adjusted under 35 U.S.C. 154(b) by 0 days.

(21) Appl. No.: 12/383,695

(22) Filed: Mar. 27, 2009

(51) Int. Cl.
*B44D 3/00* (2006.01)
*B44D 3/02* (2006.01)

(52) U.S. Cl. ..... 206/1.8; 206/1.7; 206/564; 229/117.11; 229/117.12

(58) Field of Classification Search ..... 206/443, 206/557, 562, 1.8, 1.7, 1.9, 461, 462, 563, 206/564; 220/769, 771; D9/433, 751, 755, D9/756; 229/117.11, 117.12, 117.13; D3/304, D3/307, 310; 53/457, 458, 492
See application file for complete search history.

(56) References Cited

U.S. PATENT DOCUMENTS

D170,974 S * 12/1953 Gorham ..... D9/433
2,808,191 A * 10/1957 Cramer ..... 206/562
3,001,684 A * 9/1961 Wenzel ..... 206/563
3,027,064 A * 3/1962 Thomas ..... 229/117.12
3,151,578 A * 10/1964 Jones ..... 108/46
3,201,024 A * 8/1965 Brokop ..... 206/562
4,053,099 A * 10/1977 Lock ..... 206/562
D262,945 S * 2/1982 Lytra ..... D9/415
D319,348 S * 8/1991 Monteleon ..... D3/313
5,057,282 A * 10/1991 Linder ..... 422/104
5,301,871 A * 4/1994 Gross et al. ..... 206/562
5,344,012 A * 9/1994 Matthews ..... 206/372
5,429,057 A * 7/1995 Buescher ..... 108/43
D393,591 S * 4/1998 Baryshyan ..... D9/756
6,311,842 B1 * 11/2001 Minerich et al. ..... 206/562
6,457,421 B1 * 10/2002 Apichom ..... 108/44
D484,140 S * 12/2003 Rowell ..... D14/471
D566,423 S * 4/2008 Raile ..... D6/467
2006/0278559 A1 * 12/2006 Hamblin et al. ..... 206/562
2007/0074993 A1 * 4/2007 Philips ..... 206/562

OTHER PUBLICATIONS

Art and Ink Publications 1000 Seaboard St. #C-6 Charlotte, NC 28206, Skin Art magazine Dec./ Jan. 2009 issue #124 p. 17; The Original Ink Tray.

* cited by examiner

*Primary Examiner*—David T Fidei

(57) ABSTRACT

A disposable single use ink cup holder and hand tray for stabilizing and organizing ink cups. A hand tray adjacent the ink cup holder allows a Tattoo Artist access to all the openings for the ink cups while resting his or her hand on the hand tray so any inks or body fluids on the hand stay on the single use ink cup holder and hand tray.

20 Claims, 3 Drawing Sheets

SINGLE USE INK CUP HOLDER AND HAND TRAY

FIELD OF THE INVENTION

The present invention relates to ink cup holders and, more particularly, to a single use ink cup holder and hand tray used while tattooing one person, one time and then discarded.

BACKGROUND OF THE INVENTION

Generally today's Tattoo Artists use small cylindrical plastic ink cups to hold different color inks for applying a tattoo. The ink cups come in a few different sizes. A large ink cup is approximately the size of a sewing thimble. A medium ink cup is approximately one half the size of a large ink cup and a small ink cup is approximately one half the size of a medium.

When using ink cups Tattoo Artists use an ink cup holder. Often ink cup holders are made from rectangular blocks of Plexiglas with holes bored into them to accommodate the ink cups. Other ink cup holders are made from plastic, metal and other materials. One common factor with all ink cup holders is that they are reused over and over for applying tattoos.

A problem with reusing ink cup holders is the possibility of body fluid transference. A risk factor is, ink cup holders are reused for multiple tattoos on multiple people on a daily basis. Traces of ink and or blood as well as other body fluids could remain on an ink cup holder from one person to the next.

Properly sanitizing the ink cup holder between tattooing different people is a must but does not always happen. The small bores or voids for holding the ink cups are difficult to sanitize properly. Sometimes proper care is not taken to be sure that a tool such as an ink cup holder is sanitized. The ink cup holder is given a quick wipe and it's on to the next tattoo.

In today's increasing commercialization of Tattooing there are vital concerns about transference of body fluids from person to person. Concerns such as AIDS, Hepatitis and other diseases are increasing exponentially with Tattooing.

A prior art solution called the Original Ink Tray is found in Skin ART magazine December/January 2009 issue # 124 on page 17.

The prior art solution in Skin Art December/January issue 124 is not a good solution for a few reasons. The Original Ink Trays are sold as disposable. How ever they tend to be expensive and this might keep a Tattoo Artist from throwing them away after each tattoo, resulting with the original problem. Another problem with the Original Ink Tray is that they are not ink cup holders. The ink cups are integral and are about twenty four molded onto the Original Ink Tray. Therefor Tattoo Artist have no choice of how many ink cups or sizes of ink cups. For some tattooing Tattoo Artists use only one or two ink cups per tattoo. So using one or two ink cups on the Original Ink Tray that has twenty four integral ink cups will cause the tattoo artist to reuse it on another customer and possibly a third or fourth.

Yet another problem with the Original Ink Tray is the large circular pattern that the integral ink cups are arranged. When tattooing, a tattoo gun with needles is held like a writing instrument. When the Tattoo Artist needs more ink on the needles he or she generally will rest the side of their hand next to the ink cups to stabilize the hand while dipping the needles into the ink cups. In this aspect the circular pattern is problematic. In order to reach the far ink cups the artist would either float their hand above unsupported or rest their hand on top of other integral ink cups. Floating the hand above unsupported while dipping needles could result in damage to needles if needle points were bumped against the side of an ink cup. So Tattoo Artists would tend to rest their hand for support on top of other integrated ink cups. Resting the hand on top of other ink cups would cause different color inks and body fluids on the side of the Tattoo Artists hand to be mixed in with the inks that the hand was resting on.

It would be advantageous to provide a single use ink cup holder and hand tray that would be replaced for each and every tattoo for sanitary purposes.

It would also be advantageous to provide an area with a variety of hole sizes of sufficient diameters to accommodate different sized ink cups used for Tattooing.

It would further be advantageous to provide a hand tray area where a Tattoo Artist can stabilize and rest his or her hand while accessing any of the ink cups that were put into the holder.

SUMMARY OF THE INVENTION

In accordance with the present invention, there is provided a disposable single use ink cup holder and hand tray for stabilizing and organizing ink cups. A hand tray adjacent the ink cup holder allows a Tattoo Artist access to all the openings for the ink cups while resting his or her hand on the hand tray so that any inks or body fluids on the hand stay on the single use ink cup holder and hand tray.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
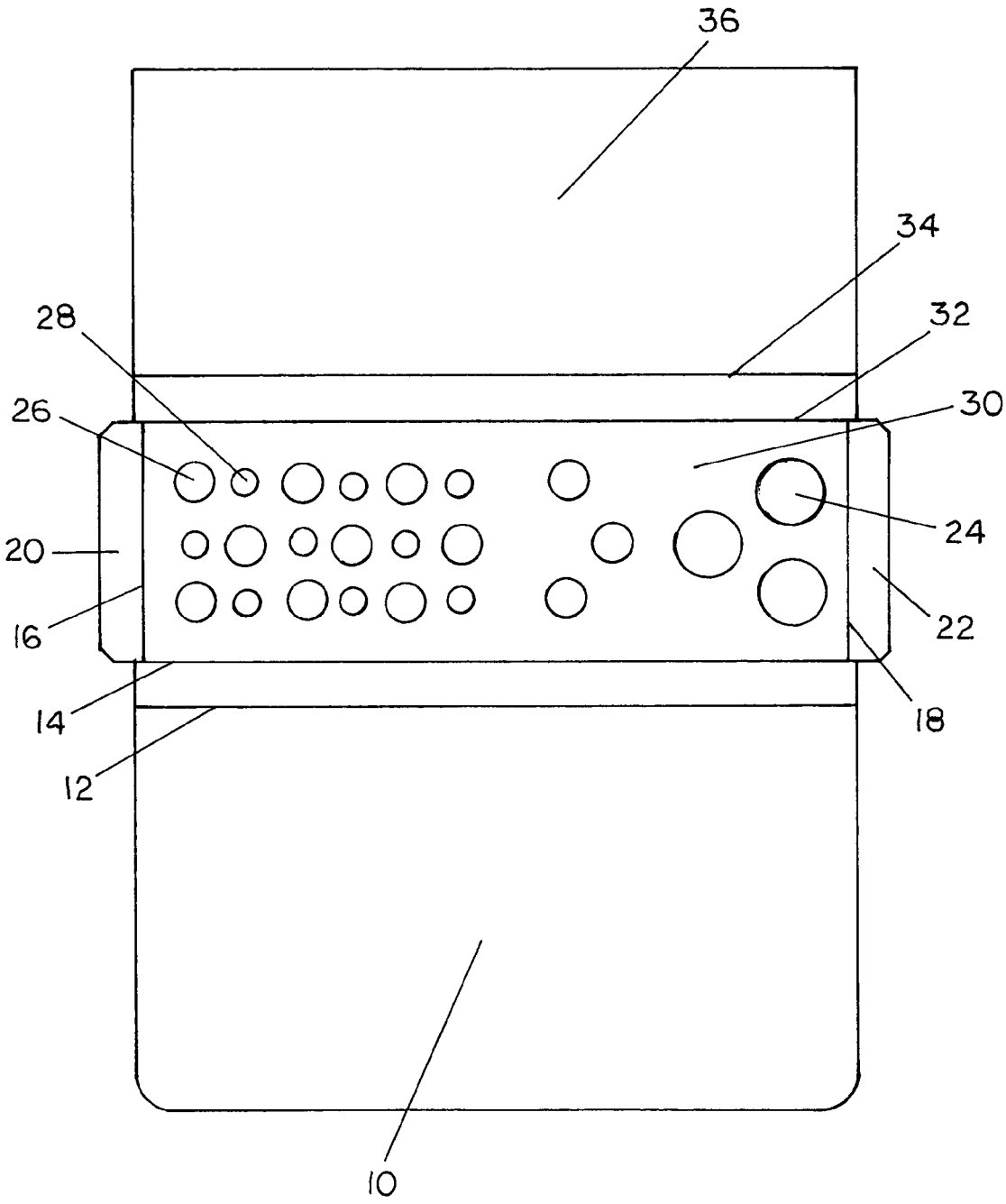
FIG. 1 is a top detail view of a flat diecut blank.

FIG. 1 is a top detail view of a flat diecut blank. This view shows the results of the first step of manufacturing a single use ink cup holder and hand tray. For this embodiment cardboard or similar paperboard stock is diecut into a blank approximately thirty two centimeters long by twenty two centimeters wide. These measurements are general and it may be assumed that the measurements could be changed larger or smaller within reason and the single use ink cup holder and hand tray would still function equally well. Most folding carton manufacturers are capable of producing this embodiment.

The hand tray section 10 is a flat area that is of adequate size to allow a person enough area to place the side of a hand on and have contact with the hand tray section 10 while accessing any one of the holes in the ink cup holding section 30.

There are a plurality of cut out holes in the ink cup holding section 30. The hole pattern for this embodiment utilizes three different sizes of cut out holes. A large cut out hole 24, a medium cut out hole 26 and a small cut out hole 28. The cut out holes are of adequate size to accommodate the three most commonly used sizes of ink cups for tattooing. The pattern arrangement of the holes in this embodiment are three parallel rows of alternating small cut out holes and medium cut out holes on the left side of the ink cup holding section 30. On the right side of the ink cup holding section 30 is a triangular pattern of three large cut out holes and three medium cut out holes in a triangle pattern towards the center. Other hole patterns can also be cut out of the ink cup holding section 30. For instance more large cut out holes and less medium and small cut out holes could be one other possible arrangement.

The front lower folding crease 12 as well as the front upper folding crease 14, rear lower folding crease 34 and rear upper folding crease 32 are pressed into the single use ink cup holder and hand tray during the die cutting process. These folding creases are to facilitate the forming of the ink cup holding section 30 for use.

Both the left side tab 20 and the right side tab 22 are utilized to strengthen and stabilize the ink cup holding section 30. Both the left side tab folding crease 16 and the right side tab folding crease 18 are to facilitate folding down the respective side tabs.

The bottom section 36 is to be folded under at the rear upper folding crease 32 and glued to the under side of the hand tray section 10 in the next step of the manufacturing process. The bottom section 36 gives the ink cup holding section 30 a bottom and gives the ink cup holding section 30 stability when opened for use.

Figure 2:
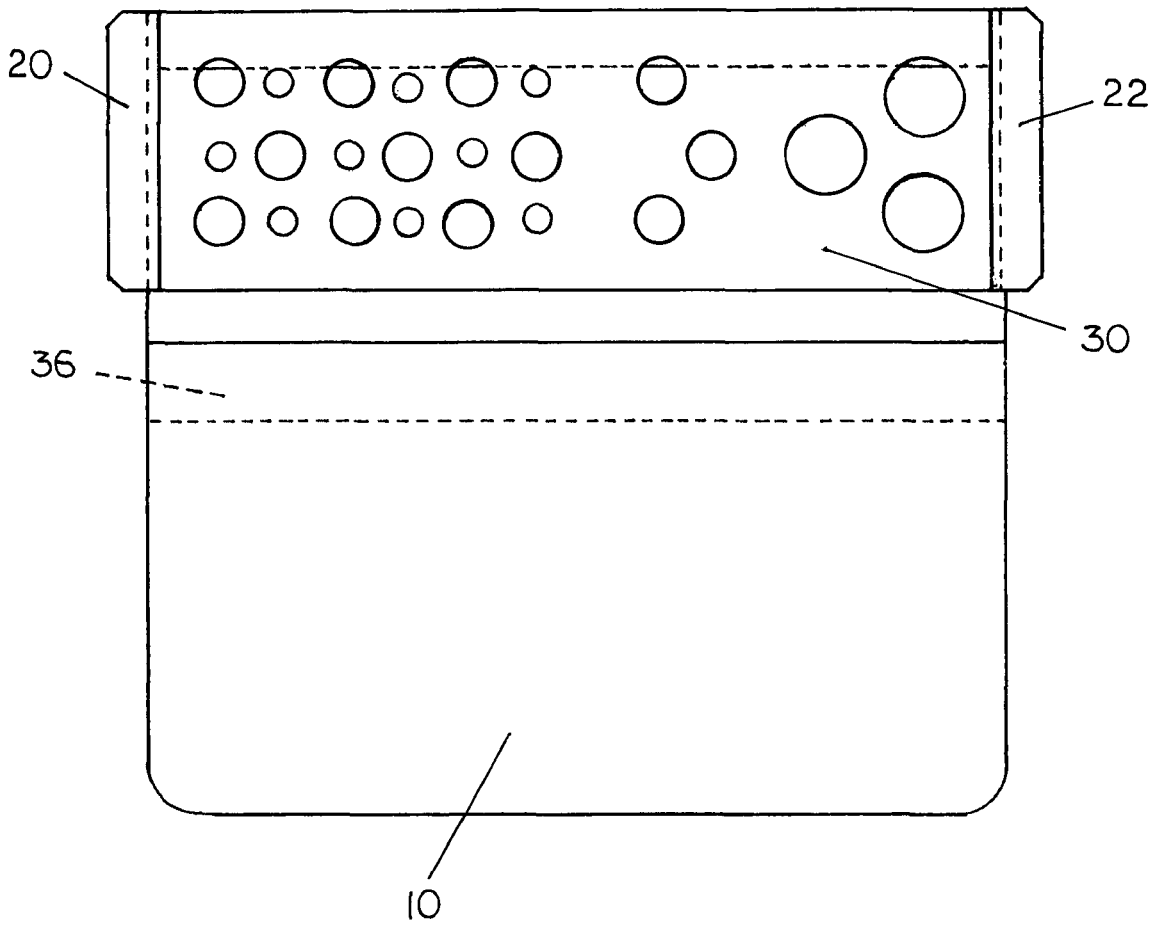
FIG. 2 is a top view of a folded and glued single use ink cup holder and hand tray.

FIG. 2 is a top view of a folded and glued single use ink cup holder and hand tray. This view shows the single use ink cup holder and hand tray fashioned typically by bending a single flat diecut blank FIG. 1 of cardboard or similar material into this requisite shape. At this point the bottom section 36 has been folded under and glued to the under side of the hand tray section 10. Also at this point the single use ink cup holder and hand tray is still in a flat state. This view shows the single use ink cup holder and hand tray in the "manufacturing complete" form.

Figure 3:
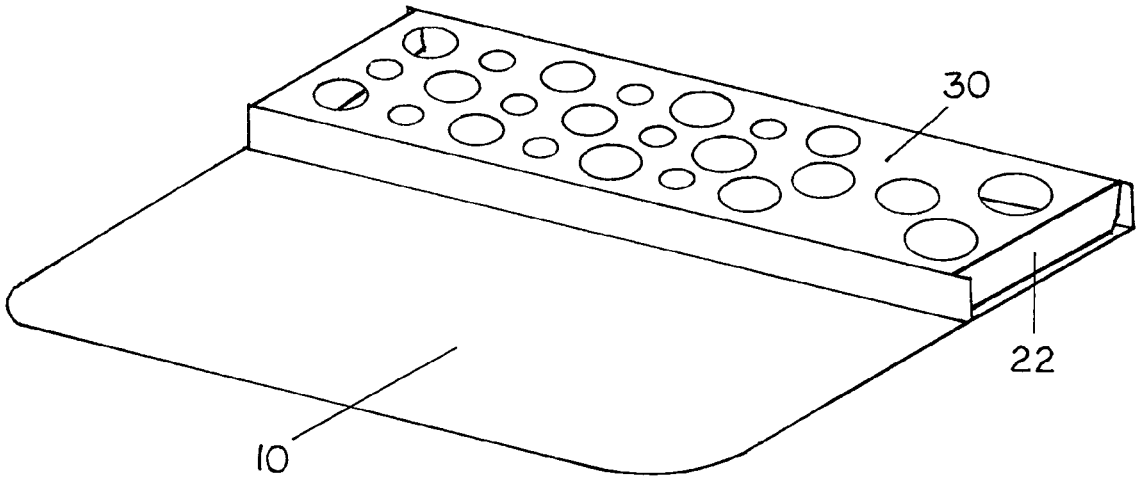
FIG. 3 is a perspective view of an opened and ready to use single use ink cup holder and hand tray.

FIG. 3 is a perspective view of an opened and ready to use single use ink cup holder and hand tray. This view shows the correlation of the flat hand tray section 10 to the now opened and formed ink cup holding section 30. This view shows the right side tab 22 folded down, this adds stability and strength to the ink cup holding section 30.

In operation this embodiment is manufactured from cardboard, paperboard or similar material. The cardboard stock would typically first be diecut into a flat diecut blank FIG. 1. During this diecut stage front lower folding crease 12, front upper folding crease 14, rear lower folding crease 34, rear upper folding crease 32, left side tab folding crease 16 and right side tab folding crease 18 are all manufactured into the diecut blank as predetermined hinging or folding areas. These folding creases facilitate the forming of the ink cup holding section 30.

The ink cup holding section 30 has a plurality of holes cut out during the diecut stage. The hole sizes and hole pattern for this embodiment is shown in FIG. 1, FIG. 2 and FIG. 3, how ever different hole patterns and different hole size combinations can be cut out at the diecut stage.

The next step in manufacturing would be to bend or fold the flat diecut blank FIG. 1 bottom section 36 under at the rear upper folding crease 32 and glue approximately 15 mm of the end of bottom section 36 to underside of hand tray section 10. FIG. 2 shows the folded and glued single use ink cup holder and hand tray in it's "manufacturing complete" state. At this point the single use ink cup holder and hand tray is still in a flattened condition.

For storage and packaging the single use ink cup holder and hand tray is flat. To use, a person would pull open the ink cup holding section 30. This is made easy by the folding creases put in during manufacturing. Once the ink cup holding section 30 is opened the left side tab 20 and the right side tab 22 are folded down. Both side tabs have predetermined folding creases to allow for easy folding and proper alignment to stabilize and strengthen the ink cup holding section 30.

The single use ink cup holder and hand tray is now formed and ready to use. The user or Tattoo Artist places the ink cups he or she wishes to use into the precut holes in the ink cup holding section 30. This embodiment will allow for multiple ink cups of different sizes to be used. The ink cups would be filled with ink. This setup would now be used in conjunction with a tattoo gun (instrument). A tattoo gun has needles and the needles are dipped into the ink cups to retrieve more ink as needed during the tattoo process. When a Tattoo Artist uses a tattooing gun it is held like a writing or drawing implement. Because the tattoo gun is held in this fashion the single use ink cup holder and hand tray is designed to allow the Tattoo Artist to rest or stabilize their hand on the hand tray and have access to any ink cup placed anywhere in the ink cup holding section 30.

Now because the Artist's hand can stay on the hand tray while accessing any of the ink cups any ink or body fluids from the person being tattooed that is on the hand of the Tattoo Artist stays on the hand tray. Because of that fact coupled with the fact that the single use ink cup holder and hand tray is produced and sold for pennies, the Tattoo Artist can and will discard the single use ink cup holder and hand tray after each tattoo. For the next tattoo a new single use ink cup holder and hand tray is used.

Using the single use ink cup holder and hand tray makes cleanup for the Tattoo Artist easier because the ink cups along with any fluids deposited on the hand tray can be picked up at once and discarded. More importantly the single use ink cup holder and hand tray solves a problem that potentially could be fatal. That is the problem of pathogens on a contaminated reusable ink cup holder. With a new single use ink cup holder and hand tray for every person being tattooed body fluid transference and the possibility of pathogens being transferred will not happen in this aspect of the tattoo process.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A tray for holding and stabilizing tattoo ink cups comprising:

a top wall having first and second opposite sides;

a pair of side walls each attached to said first and second opposite sides of the top wall such that said side walls extend away from said top wall;

said top wall having first and second opposite ends, a pair of end walls attached to said first and second opposite ends such that said end walls extend away from said top wall;

a bottom wall attached to an edge of one of said side walls such that said bottom wall extends substantially parallel to said top wall, said bottom wall bridging a distance that is at least equal to a distance between said pair of side walls;

a hand wall section attached to an edge of one of said side walls other than said one of said side walls to which said bottom wall is attached such that said hand wall section extends outwardly from said bottom wall; and, said bottom wall attached to said hand wall section such that said top wall, said side walls, said end walls and said bottom wall surround an area whereby said hand wall section extends outside said area substantially parallel to said top wall, said hand wall section providing a rest surface to place and stabilize a users hand when accessing the ink cups.

2. The tray of claim 1, wherein said top wall comprises a plurality of holes.

3. The tray of claim 2, wherein the plurality of holes includes holes of different dimensions for receiving ink cups of various sizes.

4. The tray of claim 2, wherein the plurality of holes includes at least one hole of a smallest dimension, at least one second hole of a dimension greater than that of said at least one hole and at least one third hole of a dimension greater than said second hole.

5. The tray of claim 1, wherein said pair of side walls and said bottom wall each include substantially aligned outer free edges, at least one of said first and second opposite ends of said top wall being inwardly offset from said outer free edges such that at least one of said end walls extend inwardly from said outer free edges, between said top wall and said bottom wall thereby reinforcing the tray.

6. The tray of claim 5, wherein said top wall comprises a plurality of holes.

7. The tray of claim 6, wherein the plurality of holes includes holes of different dimensions for receiving ink cups of various sizes.

8. The tray of claim 6, wherein the plurality of holes includes at least one hole of a smallest dimension, at least one second hole of a dimension greater than that of said at least one hole and at least one third hole of a dimension greater than said second hole.

9. A blank erectable into a tray for holding tattoo ink cups comprising:

a top panel having first, second, third and fourth fold lines such that said first and second fold lines are opposite one another, said third and fourth fold lines are opposite one another;

a first tab attached to said first fold line and a second tab attached to said second fold line;

first and second side panels each attached to one of said third and fourth fold lines such that a first side panel extends from one side of said top panel and a second side panel extends from a side of said top panel opposite said first side panel;

a bottom panel attached to one of said side panels by a bottom panel fold line;

an extension panel attached by a lower fold line to one of said side panels other than said one of said side panels attached to said bottom panel, said extension panel including an outer edge opposite said lower fold line;

said bottom panel having an expanse at least as large as a distance between said first and second fold lines of said top panel such that said bottom is adapted to be attached to said extension panel;

wherein said top panel and said bottom panel are adapted to be folded parallel to one another, said first and second tab extending between said top panel and said bottom panel to thereby provide an erect tray, said extension panel adapted to extend outwardly from a side of the tray such that an upper surface of said extension panel between said lower fold line and said outer edge provides a rest area for the tray.

10. The blank of claim 9, wherein said top panel comprises a plurality of holes.

11. The blank of claim 10, wherein the plurality of holes includes holes of different dimensions for receiving ink cups of various sizes.

12. The blank of claim 10, wherein the plurality of holes includes at least one hole of a smallest dimension, at least a second hole of a dimension greater than that of said at least one hole and at least a third hole of a dimension greater than said second hole.

13. The blank of claim 9, wherein said pair of side panels and said bottom panel each include substantially aligned outer free edges, at least one of said first and second fold lines of said top panel being inwardly offset from said outer free edges such that at least one said first or second tab extends inwardly from said outer free edges, said at least one first or second tab adapted to be folded substantially perpendicular to said top panel and said bottom panel thereby reinforcing the tray.

14. The blank of claim 13, wherein said top panel comprises a plurality of holes.

15. The blank of claim 14, wherein the plurality of holes includes holes of different dimensions for receiving ink cups of various sizes.

16. The blank of claim 14, wherein the plurality of holes includes at least one hole of a smallest dimension, at least a second hole of a dimension greater than that of said at least one hole and at least a third hole of a dimension greater than said second hole.

17. A method of forming a tray for holding and stabilizing objects comprising the steps of providing:

(i) a top panel having first, second, third and fourth fold lines such that said first and second fold lines are opposite one another, said third and fourth fold lines are opposite one another;

a first tab attached to said first fold line and a second tab attached to said second fold line;

first and second side panels each attached to one of said third and fourth fold lines such that a first side panel extends from one side of said top panel and a second side panel extends from a side of said top panel opposite said first side panel;

a bottom panel attached to one of said side panels by a bottom panel fold line;

an extension panel attached by a lower fold line to one of said side panels other than said one of said side panels attached to said bottom panel, said extension panel including an outer edge opposite said lower fold line;

said bottom panel having an expanse at least as large as a distance between said first and second fold lines of said top panel such that said bottom is adapted to be attached to said extension panel;

wherein said first and second side panels and said bottom panel each include substantially aligned outer free edges, at least one of said first and second fold lines of said top panel being inwardly offset from said outer free edges such that at least one of said first or second tab extends inwardly from said outer free edges;

(ii) folding the bottom panel about said bottom panel fold line and attaching an end of said bottom panel to said extension panel;

(iii) applying a force to cause said top panel to move relative to said bottom panel whereby said side panels are moved into substantially parallel alignment to one another; and, (iv) folding at least one of said first or said second tab substantially perpendicular to said top panel such that an erected tray is formed with said top panel spaced substantially parallel to said bottom panel, said extension panel projecting outwardly from said lower fold line such that an upper surface of said extension panel between said lower fold line and said outer edge provides a rest area.

18. The method of forming a tray of claim 17 further comprising; providing said top panel with a plurality of holes.

19. The method of forming a tray of claim 17 further comprising; providing said top panel with a plurality of holes having different dimensions for receiving ink cups of various sizes.

20. The method of forming a tray of claim 17 comprising; providing said top panel with a plurality of holes that includes at least one hole of a smallest dimension, at least a second hole of a dimension greater than that of said at least one hole and at least a third hole of a dimension greater than said second hole.

* * * * *